US007975348B2

(12) United States Patent
Lin

(10) Patent No.: US 7,975,348 B2
(45) Date of Patent: Jul. 12, 2011

(54) PIVOTING SLIDE HINGE

(75) Inventor: Yu-Feng Lin, Shulin (TW)

(73) Assignee: Shin Zu Shing Co., Ltd., Taipei Hsien (TW)

( * ) Notice: Subject to any disclaimer, the term of this patent is extended or adjusted under 35 U.S.C. 154(b) by 453 days.

(21) Appl. No.: 12/147,631

(22) Filed: Jun. 27, 2008

(65) Prior Publication Data

US 2009/0320244 A1 Dec. 31, 2009

(51) Int. Cl.
*E05C 17/64* (2006.01)

(52) U.S. Cl. ..... 16/337; 16/362; 16/314; 16/327; 16/345; 16/364; 384/19; 384/20

(58) Field of Classification Search ..... 16/284, 16/296, 313, 314, 277, 275, 279, 235, 88, 16/91, 93 R, 96 R, 101, 325, 327, 328, 333, 16/337, 341, 345, 352, 362, 363, 364, 239; 312/139.1, 322, 323, 223.2, 223.1, 327, 328, 312/319.2; 248/279.1, 298.1, 295.11, 285.1; 384/19, 20, 23, 42
See application file for complete search history.

(56) References Cited

U.S. PATENT DOCUMENTS 1,412,699 A * 4/1922 Manchester ..... 312/334.18
1,754,448 A * 4/1930 Vaaler ..... 312/334.9
3,488,097 A * 1/1970 Fall ..... 384/18
3,801,166 A * 4/1974 York ..... 384/18
4,089,568 A * 5/1978 Fall ..... 384/18
4,516,813 A * 5/1985 Sekerich ..... 312/323
5,169,238 A * 12/1992 Schenk ..... 384/21
5,466,060 A * 11/1995 Hoffman ..... 312/334.8
7,650,671 B2 * 1/2010 Lee ..... 16/362
7,725,988 B2 * 6/2010 Kim et al. ..... 16/361
2007/0058888 A1 * 3/2007 Chen et al. ..... 384/19
2009/0007383 A1 * 1/2009 Lee ..... 16/362
2009/0144933 A1 * 6/2009 Chen ..... 16/277
2009/0178242 A1 * 7/2009 Lin ..... 16/341
2009/0183340 A1 * 7/2009 Chiang ..... 16/327

* cited by examiner

*Primary Examiner* — Victor Batson
*Assistant Examiner* — Emily Morgan
(74) *Attorney, Agent, or Firm* — Alan Kamrath; Kamrath & Associates PA

(57) ABSTRACT

A hinge has a guiding component, a sliding component and a pivoting device. The guiding component has a base and a track. The base has a top, a free end, a pivoting end and a pivoting portion. The pivoting portion is formed on the pivoting end. The track is mounted on the top of the base near the free end and has two wings. The wings protrude out respectively and traversely from the track. The sliding component is slidably mounted around the track and has a bottom and two recesses. The recesses are formed on the bottom of the sliding component, are opposite to each other and are respectively mounted around the wings. The pivoting device is pivotally mounted to the pivoting portion of the guiding component. Therefore, the guiding component is mounted slidably on the guiding component and pivotally to the pivoting device.

6 Claims, 7 Drawing Sheets

PIVOTING SLIDE HINGE

BACKGROUND OF THE INVENTION

1. Field of the Invention

The present invention relates to a hinge and, especially, to a pivoting slide hinge mounted between a cover and a base of an electronic device to allow the cover to slide and pivotally rotate with respect to the base.

2. Description of the Prior Arts

Electronic devices such as notebook computers, cell phones and the like have a cover with a display and a base. To allow the cover to be pivoted relative to the base, a hinge is mounted between the cover and the base.

A tablet computer utilize utilizes a touchscreen or graphics tablet-screen hybrid to allows users to operate the computer with a stylus, a digital pen or a fingertip, instead of a keyboard or mouse. In particular occasions, using a keyboard or mouse for data input of the tablet computer may be favored. In this case, the keyboard or mouse is usually connected to the tablet computer by a serial buses or infrared device. However, for improved access and aesthetic arrangement, a tablet computer being equipped with a display mounted on a base and being able to pivot and slide relative to the base is desired.

However, a prerequisite of obtaining the aforesaid tablet computer is to design a hinge having a mechanism to allow the display of a tablet computer to slide and pivot relative to the base.

To overcome the shortcomings, the present invention provides a hinge to mitigate or obviate the aforementioned problems.

SUMMARY OF THE INVENTION

The main objective of the invention is to provide a pivoting slide hinge for a tablet computer.

The hinge in accordance with the present invention comprises a guiding component, a sliding component and a pivoting device. The guiding component has a base and a track. The base has a top, a free end, a pivoting end and a pivoting portion. The pivoting portion is formed on the pivoting end. The track is mounted on the top of the base near the free end and has two wings. The wings protrude out respectively and traversely from the track. The sliding component is slidably mounted around the track and has a bottom and two recesses. The recesses are formed on the bottom of the sliding component, are opposite to each other and are respectively mounted around the wings. The pivoting device is pivoted to the pivoting portion of the guiding component. Based on the structure as described above, the guiding component of the hinge in accordance with the present invention is mounted slidably on the guiding component and pivotally to a stationary leaf of the pivoting device. Therefore, the hinge in accordance with the present invention can be mounted on a tablet computer and satisfy the requirements of neat arrangement and aesthetic perception for industrial and commercial demand.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
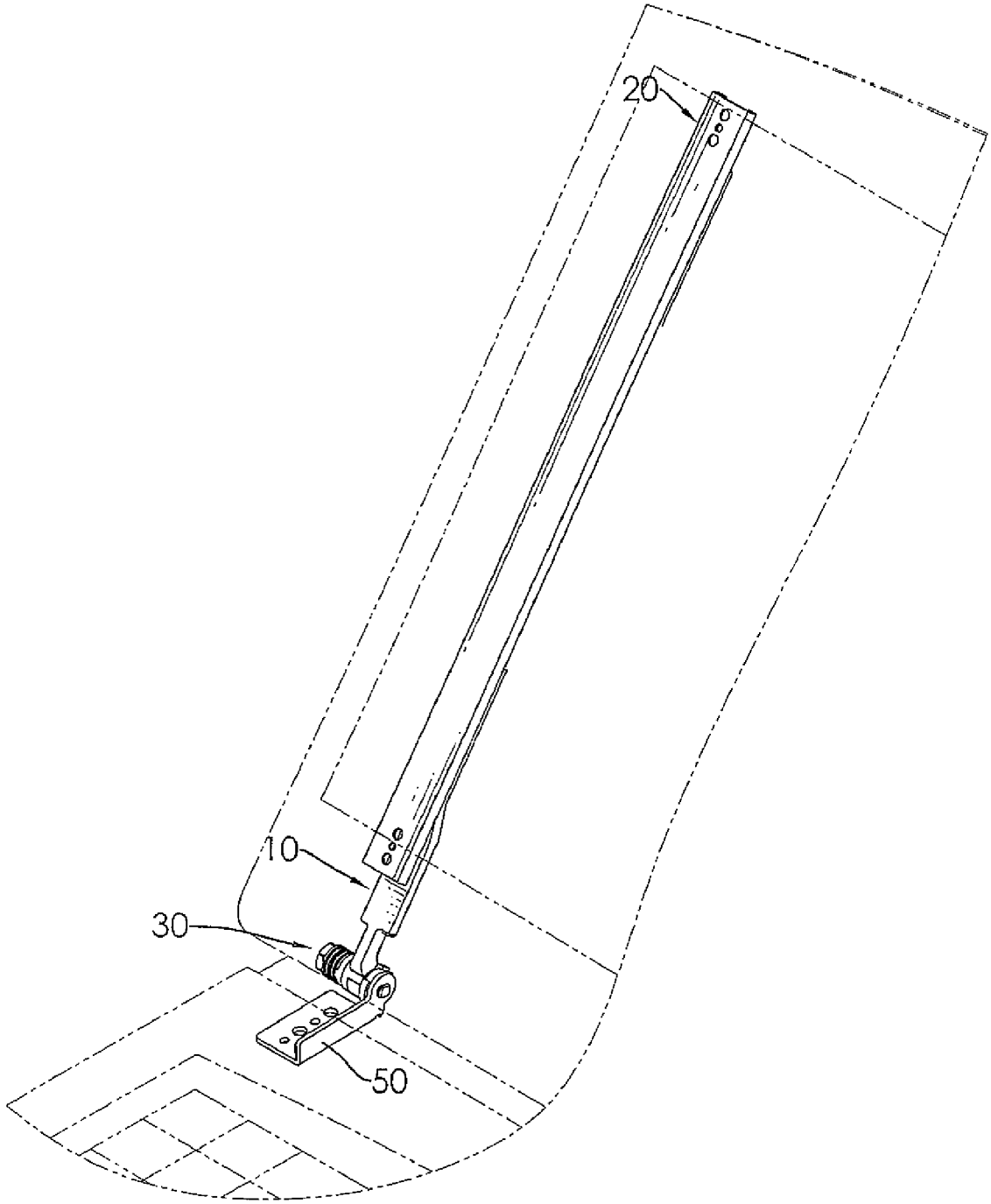
FIG. 1 is a perspective view of a hinge in accordance with the present invention.
Figure 2:
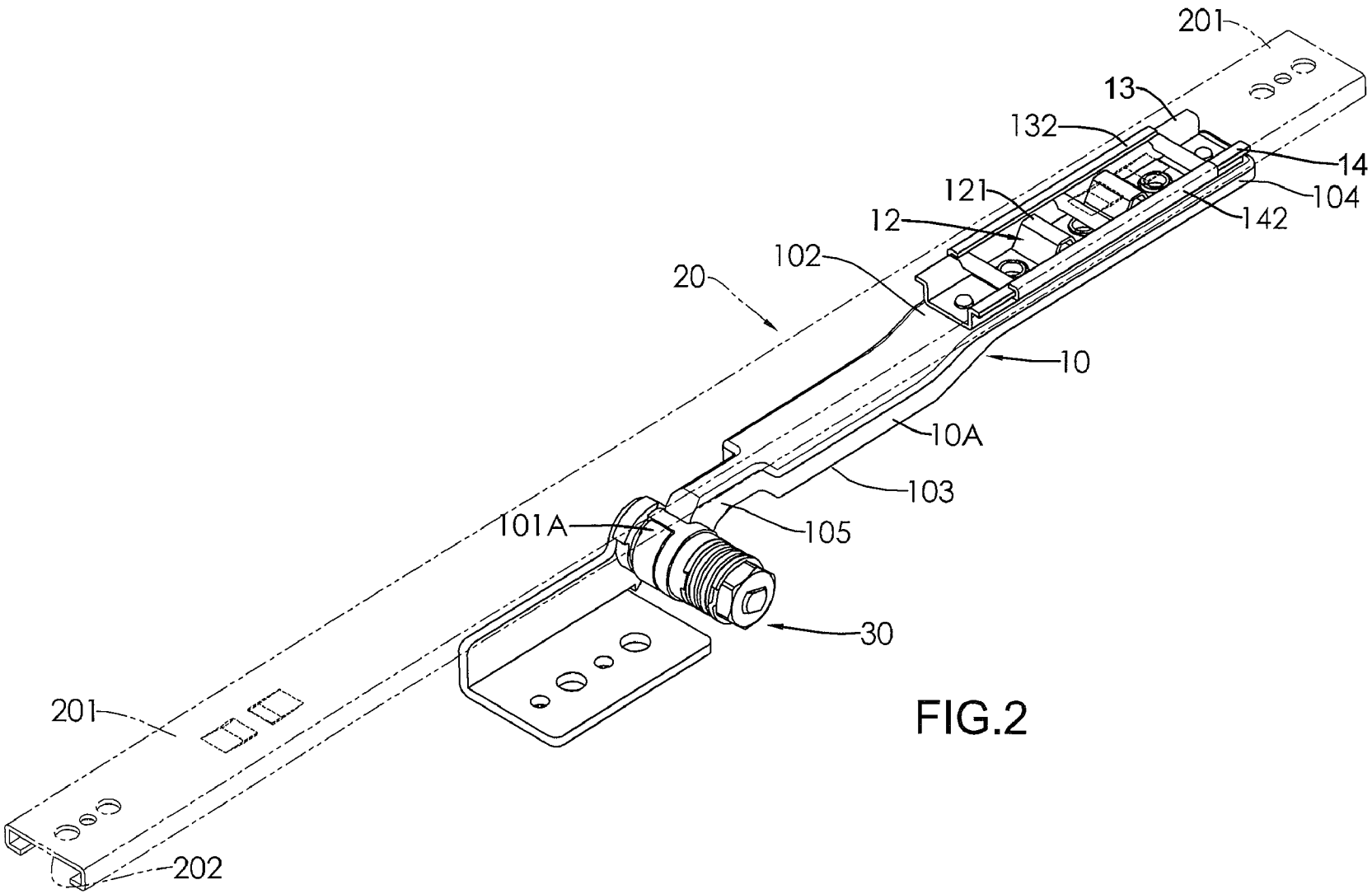
FIG. 2 is a perspective view of a guiding component and a pivoting device of the hinge in FIG. 1.

With reference to FIGS. 1 and 2, a hinge in accordance with the present invention comprises a guiding component (10), a sliding component (20) and a pivoting device (30).

Figure 3:
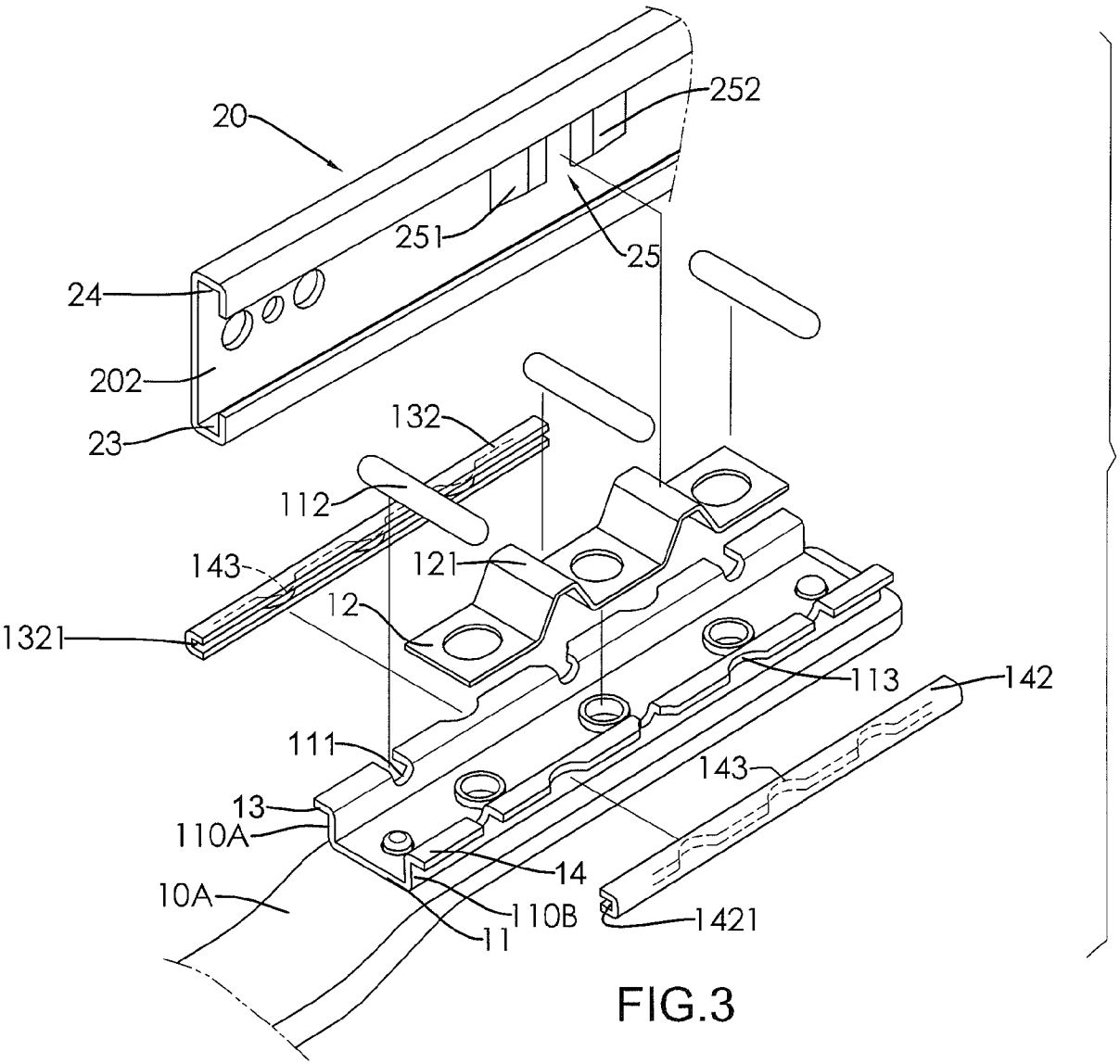
FIG. 3 is an enlarged, exploded perspective view of the guiding component and a sliding component of the hinge in FIG. 1.

With further reference to FIG. 3, the guiding component (10) has a base (10A), a track (11) and a rail (12).

Figure 7:
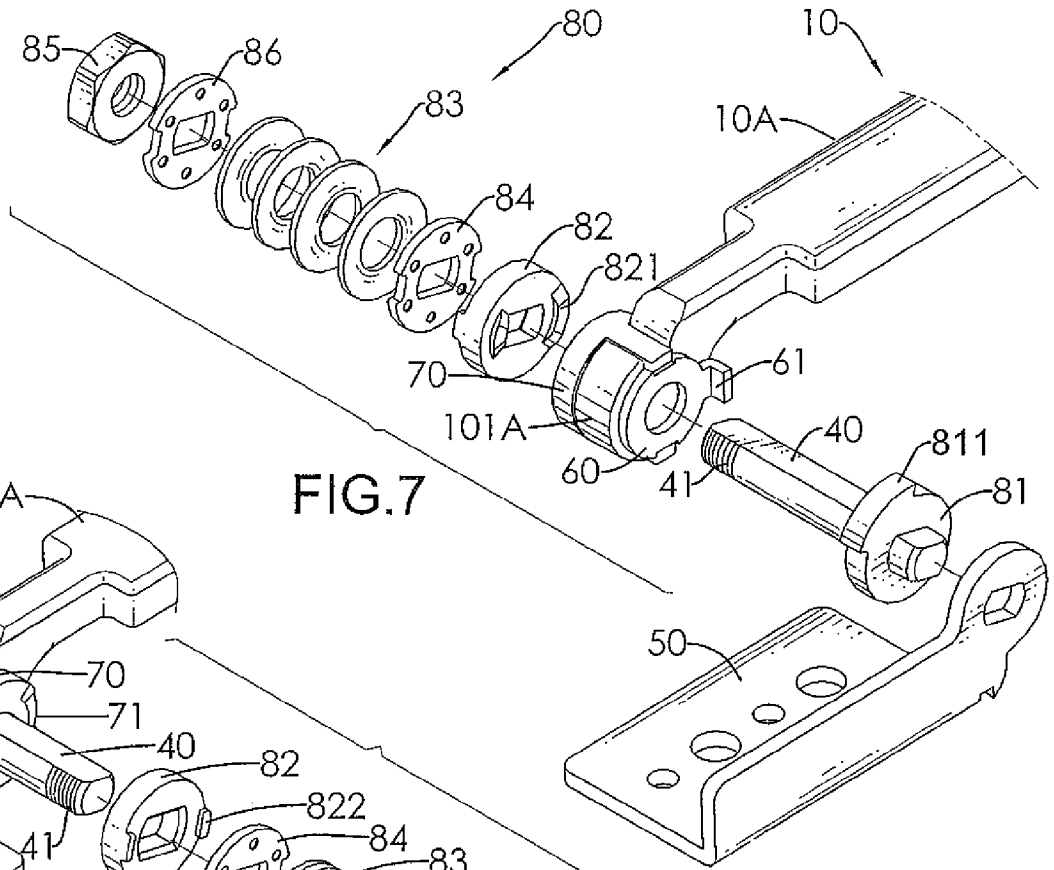
FIG. 7 is an enlarged, exploded perspective view of the guiding component and the pivoting device of the hinge in FIG. 1.

The base (10A) has a top (102), a bottom (103), a free end (104), a pivoting end (105) and a pivoting portion (101A). The pivoting end (105) is opposite to the free end (104) and extends out from the bottom (103) of the base (10A). The pivoting portion (101A) is formed on the pivoting end (105) of the base (10A) and may have an annular aperture. With further reference to FIG. 7, the aperture is formed centrally through the pivoting portion (101A) and has a rotational axis. The rotational axis is perpendicular to the base (10A).

Figure 4:
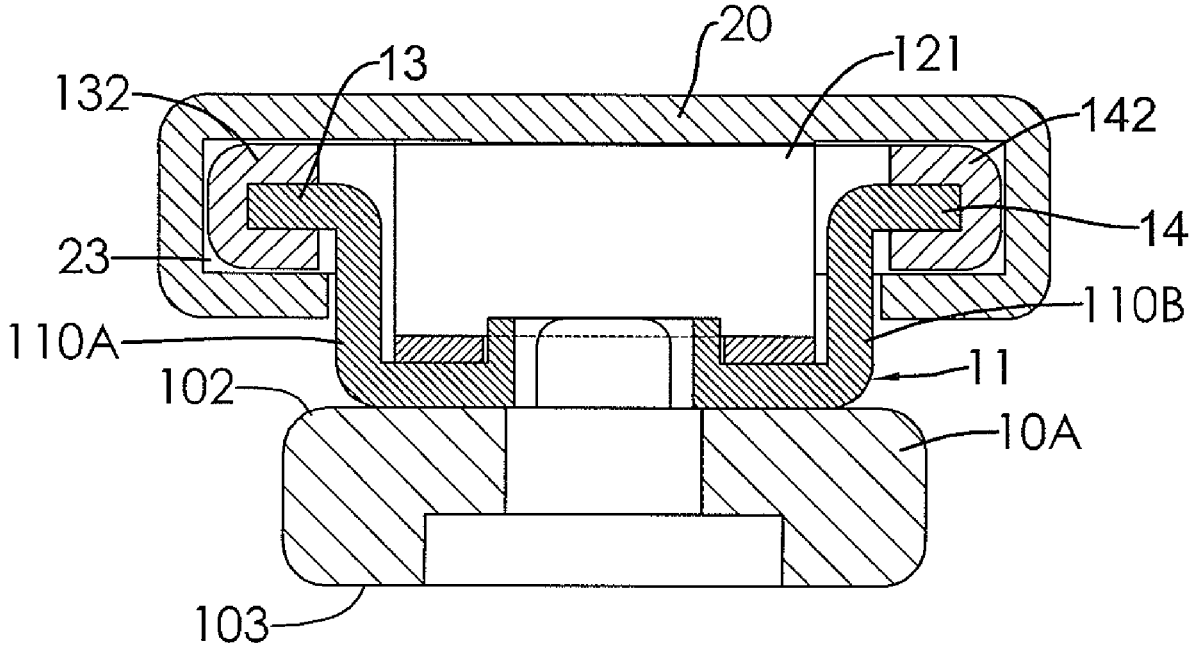
FIG. 4 is an end view in partial section of the guiding component and the sliding component of the hinge in FIG. 1.

With further reference to FIG. 4, the track (11) is mounted on the top (102) of the base (10A) near the free end (104) and has two sides (110A, 110B), two wings (13, 14), an optional groove, optional multiple rollers (112) and two optional fixed bearings (132, 142). The wings (13, 14) protrude out respectively and traversely from the sides (110A, 110B) of the track (11). Each wing (13, 14) has an edge, multiple optional gaps (111) and multiple optional notches (113). The gaps (111) are formed on the edge of each wing (13, 14) and extend toward the top (102) of the base (10A). Each gap (111) of one wing (13, 14) corresponds to one gap (111) of the other wing (13, 14). The notches (113) are formed on the edge of each wing (13, 14). The groove is formed on the top of the base (10A) between the wings (13, 14). Each roller (112) is mounted in the corresponding gaps (111) of the wings (13, 14) and across the wings (13, 14) over the groove. Each fixed bearings (132, 142) may be C-shaped in cross-section, is mounted around the corresponding wing (13, 14), and has a side, a slit (1321, 1421) and multiple bulges (143). The slit (1321, 1421) is formed through each of the fixed bearings (132, 142) and is mounted around a corresponding wing (13, 14). Each bulge (143) is formed in the slit (1321, 1421) of each fixed bearing (132,142) and is mounted in a corresponding notch (113) to prevent movement of the bearings (132, 142).

Figure 5:
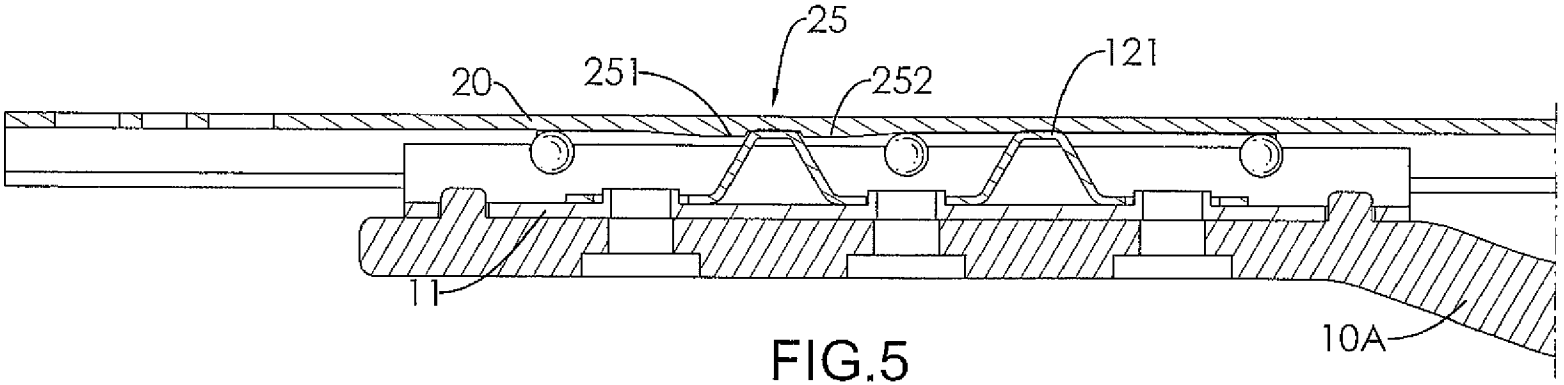
FIG. 5 is a side view in partial section of the guiding component and the sliding component of the hinge in FIG. 1.
Figure 6:
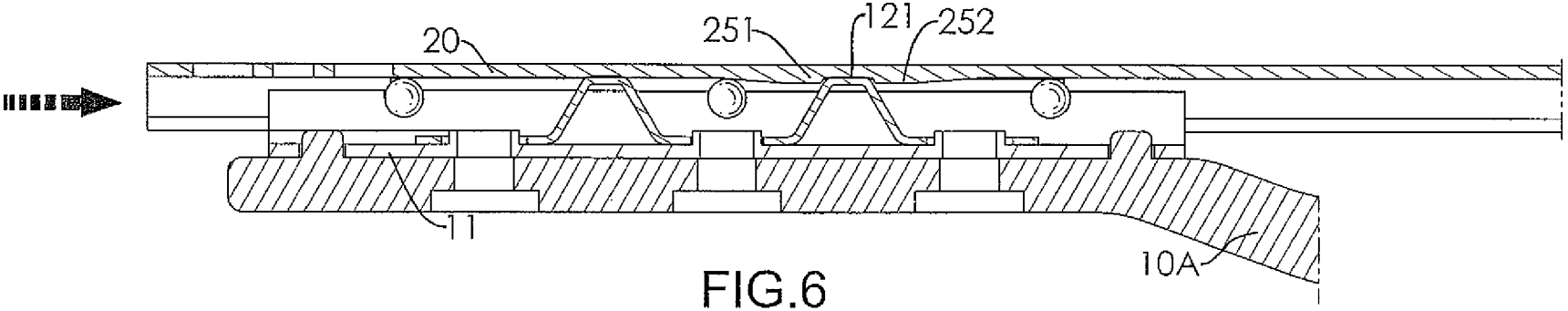
FIG. 6 is an operational side view in partial section of the guiding component and the sliding component of the hinge in FIG. 1.

With further reference to FIGS. 5 and 6, the rail (12) is mounted between the wings (13, 14) and in the groove of the base (10A) and has at least one protrusion (121). The at least one protrusion (121) is formed on and protrudes from the rail (12). Two protrusions (121) may be formed on the rail (12).

The sliding component (20) is slidably mounted around the track (11) of the guiding component (10) and has two ends (201), a top, a bottom (202), two recesses (23, 24) and at least one positioning portion (25). The recesses (23, 24) are formed in the bottom of the sliding component (20), are opposite to each other, and are respectively mounted around the wings (13, 14), and may be mounted around the fixed bearings (132, 142) such that the sliding component (20) is movably mounted on the base (10A). The positioning portion (25) is formed on the bottom (202) of the sliding component (20) between the recesses (23, 24) near one of the ends (201) of the sliding component (20) and may have two bulges (251, 252). The bulges (251, 252) are formed on the bottom (202) of the sliding component (20) adjacent to each other and selectively engage the protrusion (121) of the rail (12), whereby the positioning portion (25) of the sliding component (20) selectively engage and are held by the protrusion (121) of the base (10A).

Figure 8:
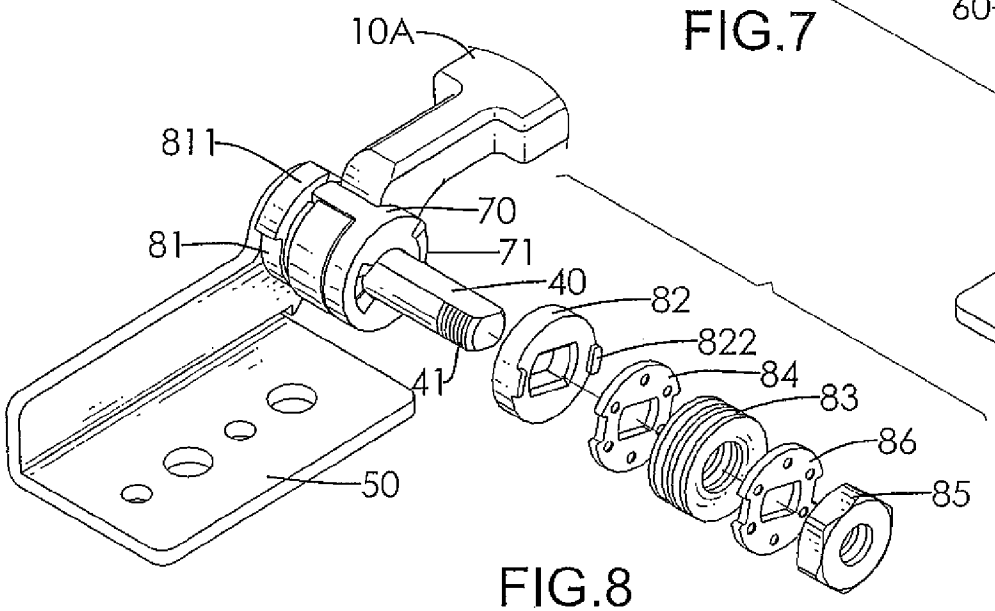
FIG. 8 is another enlarged and partially exploded perspective view of the guiding component and the pivoting device of the hinge in FIG. 1.

With further reference to FIGS. 7 and 8, the pivoting device (30) is mounted pivotally to the pivoting portion (101A) of the base (10A) of the guiding component (10) and may have a pintle (40), a stationary leaf (50), a limiting member (60), a positioning member (70), and a washer assembly (80).

The pintle (40) is non-circular in cross section and has a proximal end, a distal end and an optional threaded segment (41). The threaded segment (41) is formed around the distal end of the pintle (40).

The stationary leaf (50) is attached securely to the proximal end of the pintle (40).

The limiting member (60) is mounted securely on the pivoting portion (101A) of the base (10A) of the guiding component (10) and has an optional inner surface, an outer surface, a stop (61) and an optional hole. The inner surface faces the pivoting portion (101A). The outer surface is opposite to the inner surface and the pivoting portion (101A) of the base (10A). The hole of the limiting member (60) is formed centrally through the limiting member (60), is circular in cross section, corresponds to and is mounted around the pintle (40) and is formed coaxial to the through hole of the pivoting portion (101A). The stop (61) is formed on and protrudes from the outer surface of the limiting member (60).

The positioning member (70) is mounted securely on the pivoting portion (100A) of the base (10A) of the guiding component (10) opposite to the limiting member (60) and has an optional inner surface, an outer surface, an optional hole and a detent (71). The inner surface faces the pivoting portion (101A). The outer surface is opposite to the inner surface and pivoting portion of the base. The hole of the positioning member (70) is formed centrally through the limiting member (60), is non-circular in cross section, corresponds to and is mounted around the pintle (40) and is formed coaxial to the through hole of the pivoting portion (101A). The detent (71) is formed on the outer surface of the positioning member (70).

The washer assembly (80) is mounted around the pintle (40) and has a limiting washer (81), a positioning washer (82), a biasing member (83), an optional integrating washer (84), a fastener (85) and an optional abrasion washer (86).

The limiting washer (81) is mounted securely on the pintle (40) adjacent to the limiting member (60) and the stationary leaf (50), may be between the stationary leaf (50) and the limiting member (60), and has an annular edge and a limit (811). The limit (811) is formed on and protrudes transversely from the annular edge of the limiting washer (81) and corresponds to and selectively abuts the stop (61) on the limiting member (60) to limit a rotating angle of the pintle (40).

The positioning washer (82) is mounted securely around the pintle (40), and has an inner surface, an outer surface, an annular edge, a detent (821) and multiple optional bosses (822). The inner surface is adjacent to the positioning member (70). The outer surface is opposite to the inner surface. The detent (821) of the positioning washer (82) is formed on the outer surface of the positioning washer (82), selectively engages the detent (71) of the positioning member (70) and may be recessed.

The bosses (822) are respectively formed on and protrude from the outer surface of the positioning washer (80).

The biasing member (83) is mounted around the pintle (40) to provide a resistive force.

The integrating washer (84) is mounted securely around the pintle (40) and has an edge and multiple grooves. The grooves are respectively formed in the edge of the integrating washer (84) and correspond to and engage the bosses (822) of the positioning washer (82) to provide an additional retention force for the positioning washer (82) to ensure secure mounting on the pintle (40).

The fastener (85) is mounted securely on the distal end of the pintle (40) and may be a nut engaging the threaded segment (41) of the pintle (40).

The abrasion washer (86) is mounted securely around the pintle (40) to reduce abrasion between washers.

Figure 9:
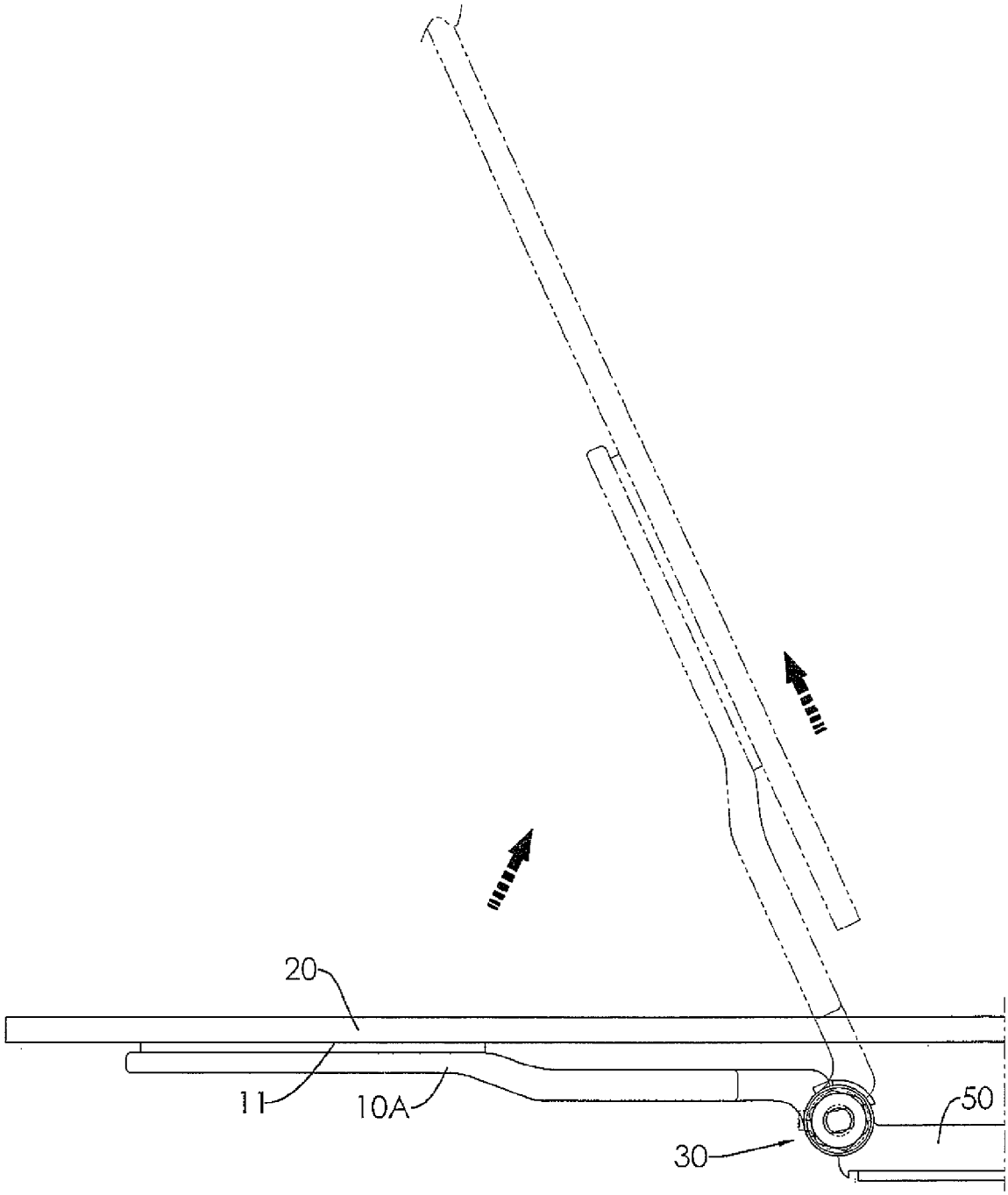
FIG. 9 is an operational end view in partial section of the hinge in FIG. 1.

With further reference to FIG. 9, the hinge as described above is mounted between a display and a base of an electronic device. The sliding component (20) is attached to the display of the electronic device and movably mounted on the track (11) of the base (10A) of the guiding component (10). The stationary leaf (50) of the pivoting device (30) is attached to the base of the electronic device.

When the end of the sliding component (20) near the pivoting end of the base (10A) slides to the free end of the base (10A) and the positioning portion (25) of the sliding component (20) engages with the protrusion (121) of the rail (12) of the guiding component (10), the sliding component (20) can be selectively fastened on the base (10A) of the guiding component (10). The base (10A) of the guiding component (10) can be further pivotally rotated by the pivoting device (30) to a particular angle to the stationary leaf (50), whereby the display of the electronic device can stand aside of the base of the electronic device for ease of viewing of the display by a user.

Even though numerous characteristics and advantages of the present invention have been set forth in the foregoing description, together with details of the structure and features of the invention, the disclosure is illustrative only. Changes may be made in the details, especially in matters of shape, size, and F arrangement of parts within the principles of the invention to the full extent indicated by the broad general meaning of the terms in which the appended claims are expressed.

What is claimed is:

1. A hinge comprising a guiding component having a base having a top;

a free end;

a pivoting end opposite to the free end; and a pivoting portion formed on the pivoting end;

a track mounted on the top of the base near the free end and having two sides; and two wings protruding out respectively and traversely from the two sides and each wing of the track having multiple gaps extending forward the top of the base, and each gap of one wing corresponding to one gap of the other wing; and multiple notches formed on the edge of the wing;

a sliding component slidably mounted around the track of the guiding component and having
two ends;
a bottom; and
two recesses formed on the bottom, opposite to each other and respectively mounted around the two wings, wherein the track further has
multiple rollers each mounted in two corresponding gaps of the two wings and across the two wings; and
two fixed bearings each mounted around one of the two wings and in one of the recesses of the sliding component and having
a slit mounted around a corresponding wing; and
multiple bulges each formed in the slit of each fixed bearing and mounted in one of the multiple notches; and
a pivoting device mounted pivotally to the pivoting portion of the base of the guiding component.

2. The hinge of claim 1, wherein
the guiding component further has
a rail mounted between the two wings and having
at least one protrusion protruding from the top of the base; and
wherein the sliding component further has
at least one positioning portion formed on the bottom of the sliding component between the two recesses near one of the two ends of the sliding component and selectively engaging the at least one protrusion of the rail.

3. The hinge of claim 2, wherein
the rail has two protrusions; and
the sliding component has
two positioning portions.

4. The hinge of claim 2, wherein the pivoting device has
a pintle non-circular in cross section and having a proximal end and a distal end;
a stationary leaf attached securely to the proximal end of the pintle;
a limiting member mounted securely on the pivoting portion of the base of the guiding component and having
an outer surface opposite to pivoting portion of the base; and
a stop formed on and protruding from the outer surface of the limiting member;
a positioning member mounted securely on the pivoting portion of the base of the guiding component opposite to the limiting member and having
an outer surface opposite to the pivoting portion of the base; and
a detent formed on the outer surface of the positioning member; and
a washer assembly mounted around the pintle and having
a limiting washer mounted securely on the pintle and having
an annular edge; and
a limit formed on and protruding traversely from the annular edge and corresponding to and selectively abutting the stop on the limiting member to limit a rotating angle of the pintle;
a positioning washer mounted securely around the pintle and having
an inner surface adjacent to the positioning member;
an outer surface opposite to the inner surface;
an annular edge; and
a detent formed on the outer surface of the positioning washer and selectively engaging the detent of the positioning member;
a biasing member being mounted around the pintle; and
a fastener being mounted securely on the distal end of the pintle.

5. The hinge of claim 1, wherein the pivoting device has
a pintle non-circular in cross section and having a proximal end and a distal end;
a stationary leaf attached securely to the proximal end of the pintle;
a limiting member mounted securely on the pivoting portion of the base of the guiding component and having
an outer surface opposite to pivoting portion of the base; and
a stop formed on and protruding from the outer surface of the limiting member;
a positioning member mounted securely on the pivoting portion of the base of the guiding component opposite to the limiting member and having
an outer surface opposite to the pivoting portion of the base; and
a detent formed on the outer surface of the positioning member; and
a washer assembly mounted around the pintle and having
a limiting washer mounted securely on the pintle and having
an annular edge; and
a limit formed on and protruding traversely from the annular edge and corresponding to and selectively abutting the stop on the limiting member to limit a rotating angle of the pintle;
a positioning washer mounted securely around the pintle and having
an inner surface adjacent to the positioning member;
an outer surface opposite to the inner surface;
an annular edge; and
a detent formed on the outer surface of the positioning washer and selectively engaging the detent of the positioning member;
a biasing member mounted around the pintle; and
a fastener mounted securely on the distal end of the pintle.

6. The hinge of claim 3, wherein the pivoting device has
a pintle non-circular in cross section and having a proximal end and a distal end;
a stationary leaf attached securely to the proximal end of the pintle;
a limiting member mounted securely on the pivoting portion of the base of the guiding component and having
an outer surface opposite to pivoting portion of the base; and
a stop formed on and protruding from the outer surface of the limiting member;
a positioning member mounted securely on the pivoting portion of the base of the guiding component opposite to the limiting member and having
an outer surface opposite to the pivoting portion of the base; and
a detent formed on the outer surface of the positioning member; and
a washer assembly mounted around the pintle and having
a limiting washer mounted securely on the pintle and having
an annular edge; and
a limit formed on and protruding traversely from the annular edge and corresponding to and selectively abutting the stop on the limiting member to limit a rotating angle of the pintle;
a positioning washer mounted securely around the pintle and having an inner surface adjacent to the positioning member;

an outer surface opposite to the inner surface;

an annular edge; and a detent formed on the outer surface of the positioning washer and selectively engaging the detent of the positioning member;

a biasing member mounted around the pintle; and a fastener mounted securely on the distal end of the pintle.

* * * * *